US010046230B1

(12) United States Patent
Knust et al.

(10) Patent No.: US 10,046,230 B1
(45) Date of Patent: Aug. 14, 2018

(54) TABLETOP INSERT FOR GAMING TABLE

(71) Applicant: Genesis Gaming Solutions, Inc., Spring, TX (US)

(72) Inventors: Randy L. Knust, The Woodlands, TX (US); Eric Schoppe, Conroe, TX (US)

(73) Assignee: Genesis Gaming Solutions, Inc., Spring, TX (US)

( * ) Notice: Subject to any disclaimer, the term of this patent is extended or adjusted under 35 U.S.C. 154(b) by 0 days.

(21) Appl. No.: 13/842,126

(22) Filed: Mar. 15, 2013

Related U.S. Application Data

(60) Provisional application No. 61/708,541, filed on Oct. 1, 2012.

(51) Int. Cl.
*A63F 3/00* (2006.01)

(52) U.S. Cl.
CPC ..... *A63F 3/00157* (2013.01)

(58) Field of Classification Search
CPC ..... G07F 17/32; G07F 17/322; A63F 2003/00164
USPC ..... 463/11, 37; 273/309
See application file for complete search history.

(56) References Cited

U.S. PATENT DOCUMENTS 4,378,114 A 3/1983 Sargent
4,531,187 A 7/1985 Uhland
5,451,054 A 9/1995 Orenstein
5,649,705 A 7/1997 String
5,653,640 A 8/1997 Shirley, Jr.
5,781,647 A 7/1998 Fishbine et al.
5,831,527 A 11/1998 Jones, II et al.
5,919,090 A 7/1999 Mothwurf
5,957,776 A 9/1999 Hoehne
6,059,659 A 5/2000 Busch et al.
6,154,131 A 11/2000 Jones, II et al.
6,267,671 B1 7/2001 Hogan
6,313,871 B1 11/2001 Schubert
6,446,864 B1 9/2002 Kim et al.
(Continued)

OTHER PUBLICATIONS

Stimpson, Jennifer, "How to Build a Poker Table", This Old House, retrieved from Internet on May 31, 2015 and published Mar. 25, 2011 from <http://web.archive.org/web/20110325082217/http://www.thisoldhouse.com/toh/how-to/step/0%2c%2c20474800_20926199%2c00.html#>, p. 9.*
(Continued)

*Primary Examiner* — Jay Liddle
*Assistant Examiner* — Ryan Hsu
(74) *Attorney, Agent, or Firm* — Winstead PC

(57) ABSTRACT

The invention generally pertains to a modular gaming table having a quick-change insert for use with a plurality of sensors associated with the gaming table. By way of example, the modular gaming table has table top with a recessed section cut into the top surface. Several light sensors are positioned within the recessed section. A removable insert is provided having a gaming table layout covering the top surface. The removable insert is sized to fit within the table top recessed section and cover the plurality of light sensors. The light sensors are configured to detect a playing card or gaming chip on the top surface of the removable insert through the gaming table layout. The removable insert is a quick-change insert meaning it is configured to be removed from the table top recessed section to replace the gaming table layout without disturbing the position of the light sensors.

17 Claims, 5 Drawing Sheets

(56) References Cited

U.S. PATENT DOCUMENTS

| | | | | |
|---|---|---|---|---|
| 6,460,848 | B1 | 10/2002 | Soltys et al. | |
| 6,567,159 | B1 | 5/2003 | Corech | |
| 6,848,994 | B1 | 2/2005 | Knust et al. | |
| 7,431,650 | B2 | 10/2008 | Kessman et al. | |
| 7,690,996 | B2 | 4/2010 | Iddings et al. | |
| 7,878,909 | B2 | 2/2011 | Kessman et al. | |
| 8,092,293 | B2 | 1/2012 | Richards et al. | |
| 8,100,753 | B2 | 1/2012 | Soltys | |
| 8,130,097 | B2 | 3/2012 | Knust et al. | |
| 8,480,091 | B1 * | 7/2013 | Florence | 273/309 |
| 8,528,909 | B2 * | 9/2013 | Gelinotte et al. | 273/309 |
| 8,636,575 | B2 | 1/2014 | Lutnick et al. | |
| 8,783,688 | B2 * | 7/2014 | Gelinotte et al. | 273/309 |
| 8,896,444 | B1 | 11/2014 | Knust et al. | |
| 2001/0010025 | A1 | 7/2001 | Knust et al. | |
| 2002/0072405 | A1 | 6/2002 | Soltys | |
| 2002/0111213 | A1 | 8/2002 | McEntee et al. | |
| 2002/0123376 | A1 | 9/2002 | Walker et al. | |
| 2003/0003997 | A1 | 1/2003 | Vuong et al. | |
| 2003/0171143 | A1 | 9/2003 | Valdez et al. | |
| 2004/0029629 | A1 * | 2/2004 | Bourbour et al. | 463/12 |
| 2004/0172772 | A1 | 9/2004 | Santiago | |
| 2004/0182772 | A1 | 9/2004 | Dannenmaier et al. | |
| 2005/0026684 | A1 | 2/2005 | Sumi et al. | |
| 2005/0090310 | A1 | 4/2005 | Knust et al. | |
| 2005/0093241 | A1 | 5/2005 | Lipscomb et al. | |
| 2005/0236771 | A1 * | 10/2005 | Soltys et al. | 273/274 |
| 2005/0277463 | A1 | 12/2005 | Knust et al. | |
| 2005/0288083 | A1 | 12/2005 | Downs | |
| 2005/0288084 | A1 * | 12/2005 | Schubert | 463/11 |
| 2005/0288086 | A1 | 12/2005 | Schubert et al. | |
| 2006/0128455 | A1 * | 6/2006 | Bourbour et al. | 463/13 |
| 2006/0177109 | A1 * | 8/2006 | Storch | 382/118 |
| 2006/0183540 | A1 | 8/2006 | Grauzer et al. | |
| 2006/0252521 | A1 | 11/2006 | Gururajan et al. | |
| 2006/0252554 | A1 | 11/2006 | Gururajan et al. | |
| 2007/0045958 | A1 | 3/2007 | Rader et al. | |
| 2007/0057469 | A1 * | 3/2007 | Grauzer | G07F 17/32 273/309 |
| 2007/0077987 | A1 | 4/2007 | Gururajan et al. | |
| 2007/0080496 | A1 | 4/2007 | Feola | |
| 2007/0117604 | A1 * | 5/2007 | Hill | G07F 17/32 463/16 |
| 2007/0296151 | A1 | 12/2007 | Kyrychenko | |
| 2008/0113767 | A1 | 5/2008 | Nguyen et al. | |
| 2008/0113772 | A1 * | 5/2008 | Burrill | G07F 17/32 463/25 |
| 2008/0136108 | A1 * | 6/2008 | Polay | 273/309 |
| 2008/0150234 | A1 * | 6/2008 | Makieil | 273/309 |
| 2009/0131151 | A1 * | 5/2009 | Harris | G07F 17/32 463/22 |
| 2009/0191933 | A1 | 7/2009 | French | |
| 2009/0253498 | A1 | 10/2009 | Wolf et al. | |
| 2011/0204565 | A1 * | 8/2011 | Gelinotte | A63F 1/06 273/237 |
| 2012/0208622 | A1 | 8/2012 | Delaney et al. | |

OTHER PUBLICATIONS

U.S. Appl. No. 14/498,281, Knust et al.
U.S. Appl. No. 14/215,392, Knust et al.
U.S. Appl. No. 14/043,692, Knust et al.
U.S. Appl. No. 13/842,416, Knust et al.
Parets, Robyn Taylor, "The newer Deal", International Gaming & Wagering Business, Apr. 1997, 2 pages.

* cited by examiner

TABLETOP INSERT FOR GAMING TABLE

TECHNICAL FIELD

Aspects of embodiments described herein apply to a modular gaming table having a quick-change table top for use with a plurality of sensors associated with the gaming table.

BACKGROUND

Changing a layout on a gaming table typically requires shutting down a table game while the new gaming table layout is installed on the table. Moreover, the current hand or chip detection devices are generally positioned on the table on top of the gaming table layout and may comprise a button or light sensor. This is very inefficient for maintenance reasons since every time a gaming table layout is changed the device must be disconnected and removed from the table. Damage is more likely from the device being exposed on the table top.

Moreover, regularly changing gaming table layouts the traditional way can also affect the placement of the gaming spots relative to bet and card tracking sensors that may be installed in the table. If the layout is not placed accurately, the sensors may not work correctly. So, against that backdrop, a need currently exists for a modular gaming table that allows casino staff to quickly and easily change out a gaming table layout upon expiration of its useful life while also providing accurate placement of the bet spots on the layout relative to tracking sensors mounted beneath the layout on the table.

BRIEF SUMMARY

In one embodiment, a modular gaming table is provided having a table base and a table top with a top surface and bottom surface secured to the table base. The table top also has a table top recessed section cut into the top surface. A plurality of light sensors are positioned within the recessed section. A removable insert is provided having a top surface and a bottom surface. In the illustrated embodiment, the removable insert has a gaining table layout covering the top surface. The removable insert is sized to fit within the table top recessed section and cover the plurality of light sensors. The removable insert is configured to be removed from the table top recessed section to replace the gaining table layout, thus making the top a quick-change insert.

New gaming table layouts can be switched out in minutes, allowing a casino the flexibility to adjust its table game mix as necessary and limiting the amount of downtime for the gaming table. In addition, a quick-change tabletop ensures precise layout placement with regard to the location of tracking sensors, guaranteeing more accurate sensor reading for player and game tracking purposes.

In another embodiment, A modular gaming table a modular gaming table is provided having a table base and a table top with a top surface and bottom surface secured to the table base. The table top also has a table top recessed section cut into the top surface. The modular gaming table has a first removable insert having a top surface and bottom surface, the top surface having a plurality of light sensors secured thereto. The first removable insert is configured to be a quick-change apparatus by removing the insert from the table top recessed section so as to be repaired or replaced. The modular gaming table provides a second removable insert having a top surface and a bottom surface. The second removable insert has a gaming table layout covering the top surface with a plurality of bet spots printed thereon.

The second removable insert is sized to fit within the table top recessed section with the first removable insert. The second removable insert is also configured to be a quick-change apparatus by removing the insert from the table top recessed section so as to replace the gaming table layout. The first removable insert and the second removable insert are sized and configured to be positioned within the table top recessed section in a stacked arrangement.

In yet another embodiment, the top surface of the removable insert is approximately coplanar with the top surface of the table top when the removable insert is positioned within the table top recessed section.

In still another embodiment, the gaming table layout further comprises an installation marking matching the size and shape of the removable insert. The installation marking assists a user to properly position the gaming table layout on the removable insert and align the bet spots on the gaming table layout with the plurality of light sensors secured to the table top.

In yet another embodiment, the plurality of light sensors are secured to the table top within the recessed section. The light sensors configured to detect a playing card or gaming chip on the top surface of the removable insert through the gaming table layout.

A method of replacing a gaming table layout on a modular gaming table is also provided. The user is provided with a table base and a table top having a top surface and bottom surface secured to the table base. The table top has a table top recessed section cut into the top surface. The table top is secured to the table base. A plurality of light sensors are positioned within the recessed section. A removable insert is provided having a top surface and a bottom surface. The removable insert has a gaming table layout covering the top surface. The removable insert is sized to fit within the table top recessed section and cover the plurality of light sensors. The removable insert is configured to be removed from the table top recessed section to facilitate removing and replacing the gaming table layout. The gaming table layout further comprises a plurality of bet spots printed thereon, configured to cover the plurality of light sensors when the removable insert is positioned within the table top recessed section.

Continuing with the method, the removable insert is removed from the table top recessed section. The gaming table layout is then removed from the top surface of the removable insert. A replacement gaming table layout is then secured to the top surface of the removable insert. The removable insert is then repositioned within the table top recessed section.

The foregoing and other features, utilities and advantages of the invention will be apparent from the following more particular description of various embodiments of the invention as illustrated in the accompanying drawings and claims.

BRIEF DESCRIPTION OF THE DRAWINGS

A more complete understanding of the method and apparatus of the present invention may be obtained by reference to the following Brief Description when taken in conjunction with the accompanying Drawings wherein.

BRIEF DESCRIPTION

In the following description, numerous specific details are set forth, such as examples of specific shapes, components etc., in order to provide a thorough understanding of the present invention. It will be apparent, however, to one skilled in the art that the present invention may be practiced without these specific details. In other instances, well known components or methods have not been described in detail, but rather in general terms in order to avoid unnecessarily obscuring the present invention. Thus, the specific details set forth are merely exemplary. The specific details may be varied from and still be contemplated to be within the spirit and scope of the present invention.

Reference to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices. It is further contemplated within the scope of this invention that calculations can also be done mentally, manually or using processes other than electronic.

Figure 1:
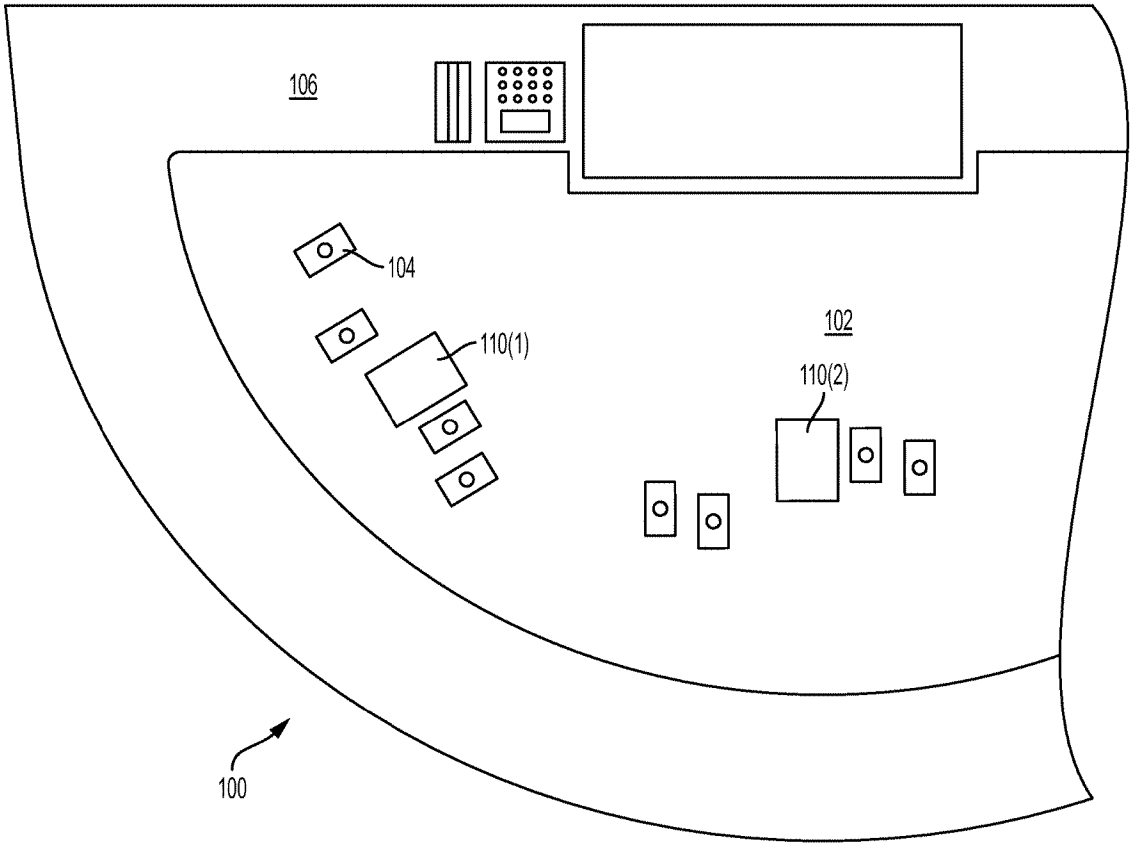
FIG. 1 illustrates a gaming table having a tabletop surface and a recessed portion.

FIG. 1 illustrates a gaming table top 100 having a tabletop surface 106 and a recessed portion 102. The recessed portion 102 generally corresponds to a playing region of the gaming table top 100. As used herein, a playing region refers to an area of a gaming table where gaming activities occur. Gaming activities can include, for example, dealing cards, placing bets, and the like. As shown, the recessed portion 102 exposes a plurality of light sensors 104, a hub 110(1), and a hub 110(2). In a typical embodiment, the plurality of light sensors 104 operate similarly to light sensors shown and described in Appendix A. Therefore, the plurality of light sensors 104 are typically operable to facilitate detection of certain gaming activities. As shown, the hub 110(1) and the hub 110(2) are made accessible for purposes of servicing wiring and connections among gaming-table equipment such as, for example, the plurality of light sensors 104.

Figure 2:
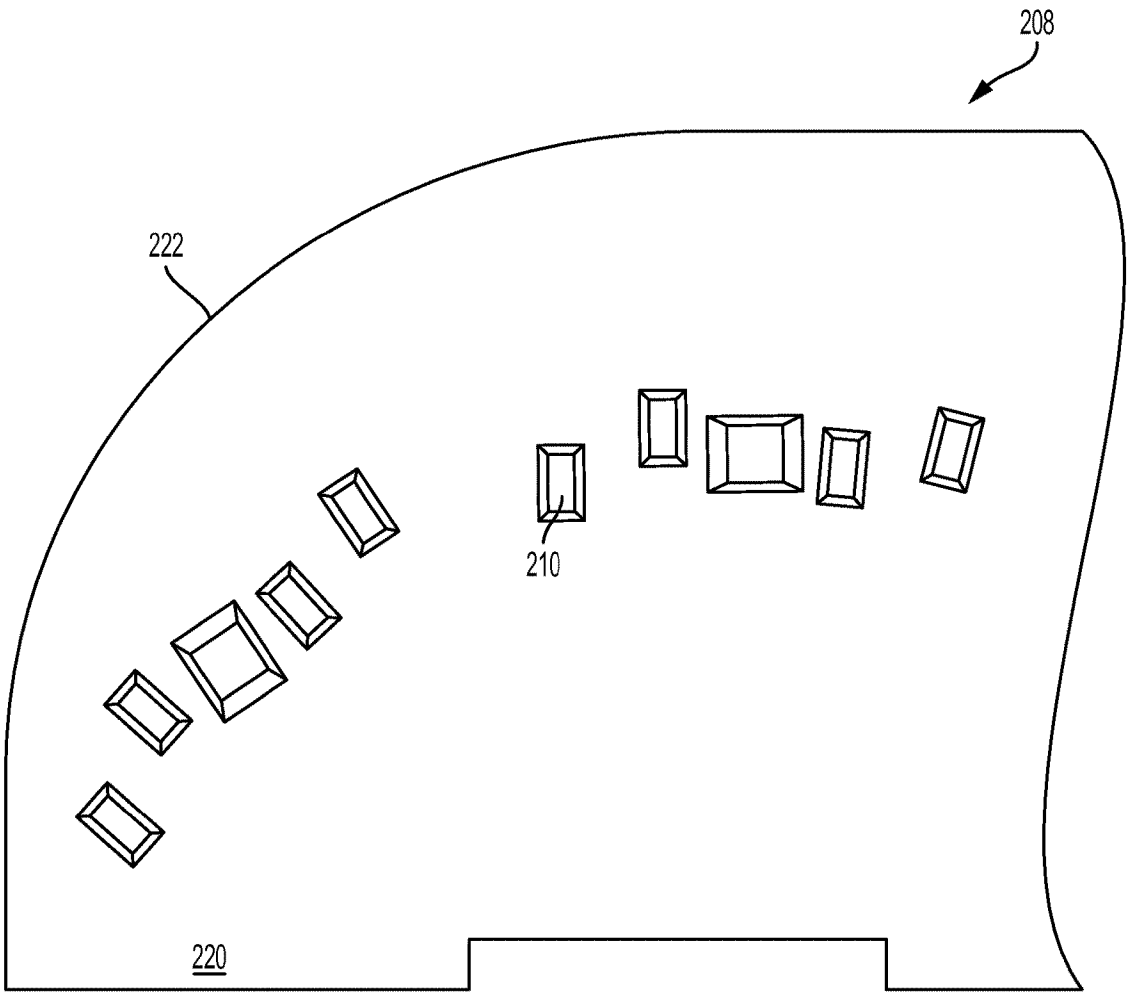
FIG. 2 illustrates a template insert.

FIG. 2 illustrates a template insert 208 operable to be placed over the plurality of sensors 104 and within the recessed portion 102. The template insert 208 conforms to a shape and specification of the recessed portion 102. Accordingly, the template insert 208 includes a plurality of openings 210 that match a shape and location of the plurality light sensors 104 of FIG. 1. In addition, the template insert 208 is engineered so that, when table felt is installed on a top surface 220 of the template insert 208 and the template insert 208 is placed within the recessed portion 102, the template insert 208 is substantially flush with the tabletop surface 106 of FIG. 1. The template insert 208 also includes a bottom surface 222.

Figure 3:
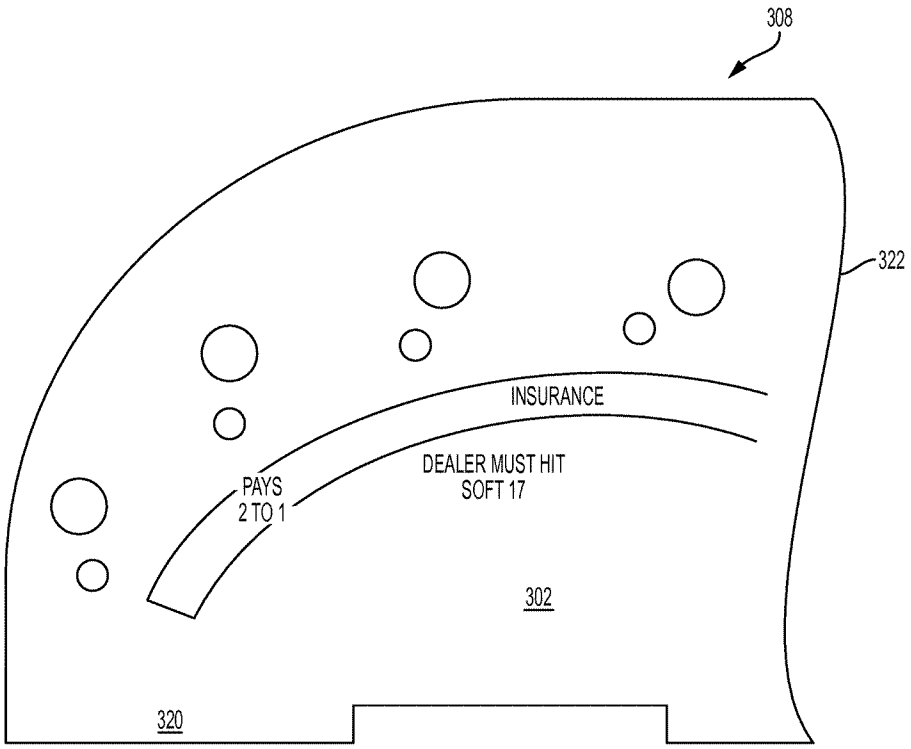
FIG. 3 illustrates a felt-covered template insert.

FIG. 3 illustrates a felt-covered template insert 308. In a typical embodiment, the felt-covered template insert 308 is the template insert 208 with a table felt 302 installed thereon. A dashed line along the table felt 302 indicates where the table felt 302 should engage a periphery of the template insert 208. As a result, the table felt 302 can be installed on the template insert 208 with a high degree of precision and accuracy.

Figure 4:
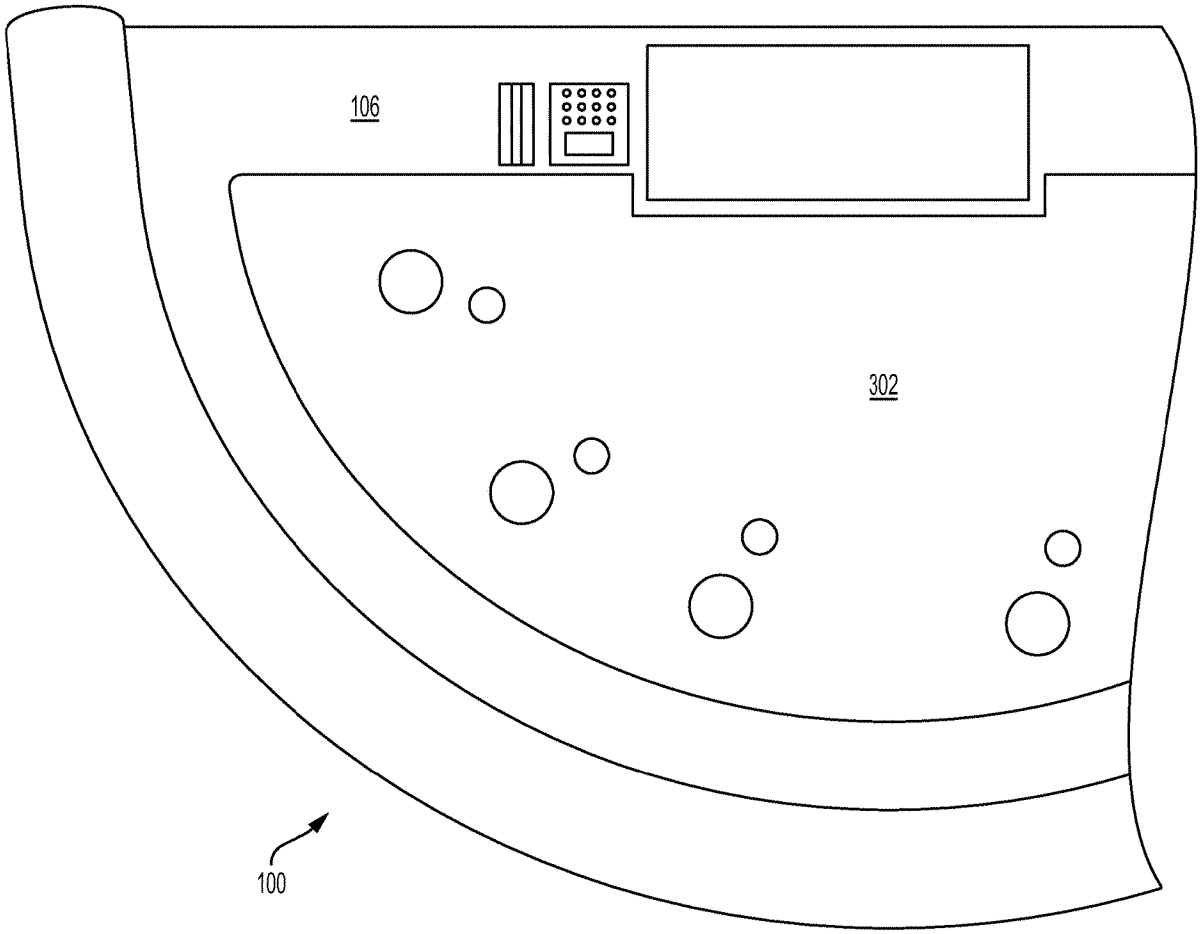
FIG. 4 illustrates a felt-covered template insert installed within a recessed portion of a gaming table.

FIG. 4 illustrates the felt-covered template insert 308 installed within the recessed portion 102 of FIG. 1. The felt-covered template insert 308 comprises a top surface 320 and a bottom surface 322. The felt-covered template insert 308 is installed by being placed over the plurality of sensors 104 so that the bottom, non-felt-covered surface 322 of the felt-covered template insert 308 engages the recessed portion 102 and locks into place. In a typical embodiment, a height of the felt-covered template insert 308 is substantially the same as an amount the plurality of light sensors 104 protrude from the recessed portion 102. Once installed, the felt-covered template insert 308 is typically substantially flush with a tabletop surface 106. In addition, utilization of the felt-covered template insert 308 substantially reduces the risk of felt misalignment relative to the plurality of sensors 102.

Figure 5:
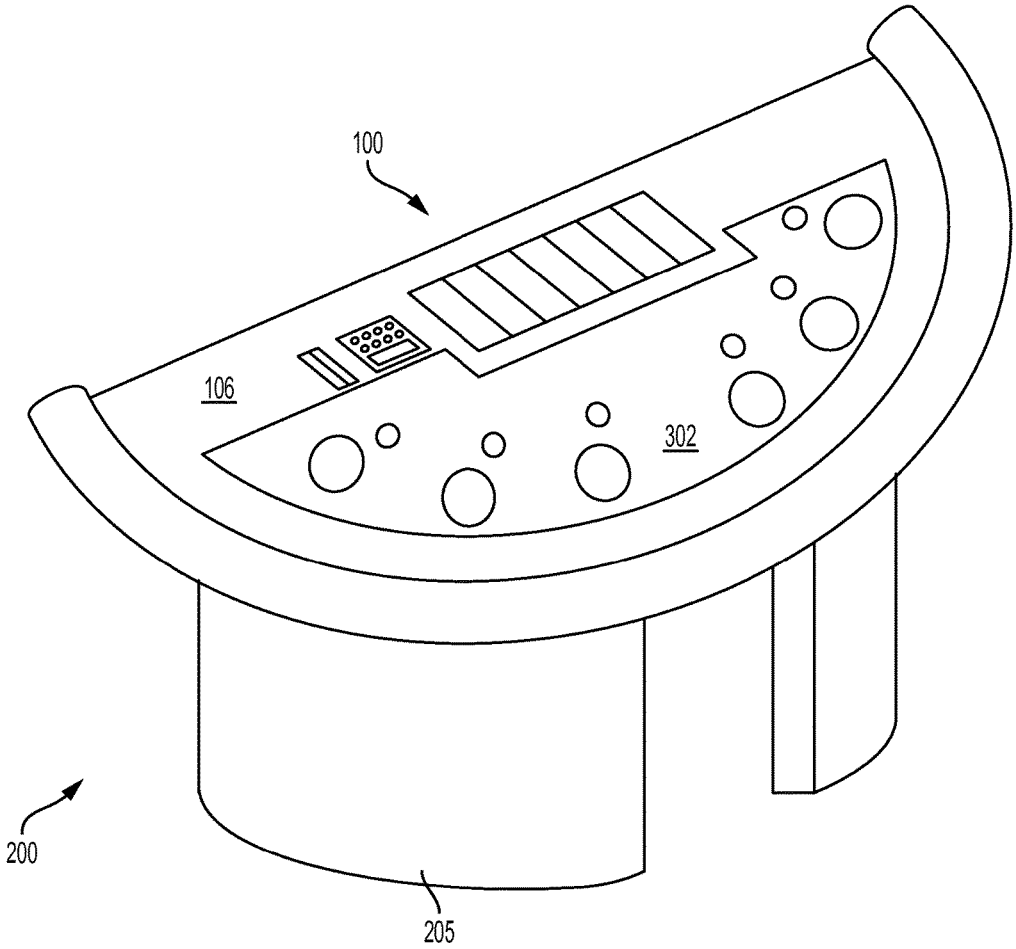
FIG. 5 illustrates a complete modular gaming table.

FIG. 5 shows a complete modular gaming table 200 having a gaming table top 100 and a gaming table base 205. The bottom surface of the gaming table top 100 is secured to the gaming table base 205. Modular gaming table 200 may be used for any number of casino table games, such as blackjack, poker, craps, roulette, baccarat and any number of unique carnival games to name a few. The specific game dictates where the bet spots will be located on the gaming table layout, which further determine where the light sensors are positioned beneath the layout on the modular gaming table 200.

Moreover, in various embodiments, the principles described above can reduce downtime at a gaming establishment such as, for example, a casino. In a typical embodiment, the casino maintains a plurality of template inserts that already have table felt installed thereon (i.e., felt-covered template inserts). In that way, when table felt needs to be replaced at a given gaming table, casino personnel can remove a felt-covered template insert and immediately replace with another felt-covered template insert. The felt on the removed template insert can then be replaced at a more convenient time without causing gaming-table downtime.

While the foregoing written description of the invention enables one of ordinary skill to make and use what is considered presently to be the best mode thereof, those of ordinary skill will understand and appreciate the existence of variations, combinations, and equivalents of title specific embodiment, method, and examples herein. The invention should therefore not be limited by the above described embodiment, method, and examples, but by all embodiments and methods within the scope and spirit of the invention.

We claim:

1. A modular gaming table, comprising:

a table base;

a table top comprising a top surface and bottom surface, the bottom surface of the table top secured to the table base, the table top having a recessed section in the top surface thereof;

a plurality of light sensors positioned within the recessed section; and a removable insert placed over the plurality of light sensors and within the recessed section, the removable insert comprising a top surface and a bottom surface, the removable insert having a gaming table layout that covers the top surface of the removable insert and the plurality of light sensors such that the plurality of light sensors are positioned beneath the gaming table layout; and wherein the removable insert is configured to be removed from the recessed section.

2. The modular gaming table of claim 1, wherein the top surface of the removable insert is approximately coplanar with the top surface of the table top when the removable insert is positioned within the recessed section.

3. The modular gaming table of claim 1, wherein the plurality of light sensors are secured to the table top within the recessed section, and wherein the light sensors are configured to detect a playing card or gaming chip on the top surface of the removable insert through the gaming table layout.

4. The modular gaming table of claim 1, wherein the gaming table layout further comprises an installation marking, wherein the installation marking matches a size and shape of the removable insert to properly position the gaming table layout on the removable insert and align bet spots on the gaming table layout with the plurality of light sensors secured to the table top.

5. The modular gaming table of claim 1, wherein the removable insert further comprises a plurality of insert recessed portions configured to cover the plurality of light sensors when the removable insert is positioned within the recessed section.

6. The modular gaming table of claim 1, wherein the removable insert and the recessed section are semi-circular in shape.

7. The modular gaming table of claim 1, wherein the gaming table layout further comprises a plurality of bet spots printed thereon, wherein one or more of the plurality of bet spots are configured to cover one or more of the plurality of light sensors when the removable insert is positioned within the recessed section.

8. A modular gaming table, comprising:

a table base;

a table top comprising a top surface and bottom surface, the bottom surface of the table top secured to the table base, the table top having a recessed section in the top surface thereof;

a first removable insert placed within the recessed section, the first removable insert comprising a top surface and bottom surface, the top surface of the first removable insert having a plurality of light sensors secured thereto, the first removable insert configured to be removed from the recessed section to be repaired or replaced;

a second removable insert placed over the plurality of light sensors and within the recessed section, the second removable insert comprising a top surface and a bottom surface, the second removable insert having a gaming table layout that covers the top surface of the second removable insert and the plurality of light sensors such that the plurality of light sensors are positioned beneath the gaming table layout, the gaming table layout having a plurality of bet spots printed thereon;

wherein the second removable insert is configured to be removed from the recessed section to replace the gaming table layout; and wherein the first removable insert and the second removable insert are sized and configured to be positioned within the recessed section in a stacked arrangement.

9. The modular gaming table of claim 8, wherein the top surface of the second removable insert is approximately coplanar with the top surface of the table top when the first removable insert and the second removable insert are positioned within the recessed section.

10. The modular gaming table of claim 8, wherein the plurality of light sensors are secured to the top surface of the table top, and wherein the plurality of light sensors are configured to detect a playing card or gaming chip on the top surface of the second removable insert through the gaming table layout.

11. The modular gaming table of claim 8, wherein the gaming table layout further comprises an installation marking, wherein the installation marking matches a size and shape of the second removable insert to properly position the gaming table layout on the first removable insert and align bet spots on the gaming table layout with the plurality of light sensors on the first removable insert.

12. The modular gaming table of claim 8, wherein the second removable insert further comprises a plurality of insert recessed portions on the bottom surface of the second removable insert, the plurality of insert recessed portions configured to cover the plurality of light sensors when the second removable insert is positioned within the recessed section.

13. The modular gaming table of claim 8, wherein the first removable insert, the second removable insert and the recessed section are semi-circular in shape.

14. The modular gaming table of claim 8, wherein one or more of the plurality of bet spots are configured to cover one or more of the plurality of light sensors when the second removable insert is positioned within the recessed section.

15. A method of providing a modular gaming table, comprising:

providing a table base;

providing a table top comprising a top surface and a bottom surface, the bottom surface of the table top secured to the table base, the table top having a recessed section in the top surface thereof;

securing the table top to the table base;

providing a plurality of light sensors positioned within the recessed section;

providing a removable insert that is placed over the plurality of light sensors within the recessed section, the removable insert comprising a top surface and a bottom surface, the removable insert having a gaming table layout that covers the top surface of the removable insert and the plurality of light sensors such that the plurality of light sensors are positioned beneath the gaming table layout;

wherein the removable insert is configured to be removed from the recessed section to replace the gaming table layout; and wherein the gaming table layout further comprises a plurality of bet spots printed thereon, the plurality of bet spots configured to cover the plurality of light sensors when the removable insert is positioned within the recessed section.

16. The method of claim 15, further comprising providing a second removable insert having a top surface and bottom surface, the second removable insert configured to be positioned within the recessed section prior to inserting the removable insert, the second removable insert configured to be removed from the recessed section to be repaired or replaced.

17. A method of replacing a gaming table layout on a modular gaming table, the method comprising:

providing a table base;

providing a table top comprising a top surface and bottom surface, the bottom surface of the table top secured to the table base, the table top having a recessed section in the top surface thereof;

securing the table top to the table base;

providing a plurality of light sensors positioned within the recessed section;

providing a removable insert that is placed over the plurality of light sensors within the recessed section, the removable insert comprising a top surface and a bottom surface, the removable insert having a gaming table layout that covers the top surface of the removable insert and the plurality of light sensors such that the plurality of light sensors are positioned beneath the gaming table layout;

wherein the removable insert is configured to be removed from the recessed section to replace the gaming table layout;

wherein the gaming table layout further comprises a plurality of bet spots printed thereon, the plurality of bet spots configured to cover the plurality of light sensors when the removable insert is positioned within the recessed section;

removing the removable insert from the recessed section;

removing the gaming table layout from the top surface of the removable insert;

securing a replacement gaming table layout to the top surface of the removable insert; and positioning the removable insert within the recessed section.

* * * * *